US006283328B1

(12) United States Patent
Vojvodic

(10) Patent No.: US 6,283,328 B1
(45) Date of Patent: Sep. 4, 2001

(54) PITCHER PUMP WATER DISPENSING SYSTEM

(76) Inventor: John Vojvodic, 9832 Princess La., Hudson, FL (US) 34667

( * ) Notice: Subject to any disclaimer, the term of this patent is extended or adjusted under 35 U.S.C. 154(b) by 0 days.

(21) Appl. No.: 09/766,854

(22) Filed: Jan. 19, 2001

(51) Int. Cl.[7] ..... B67D 5/08; B67D 5/14; B67D 5/40

(52) U.S. Cl. ..... 222/67; 222/383.1; 222/382

(58) Field of Search ..... 222/324, 67, 383.1, 222/608, 64, 65, 382; 417/36, 40; 137/409; 141/42, 199, 212, 216, 220, 229, 303

(56) References Cited

U.S. PATENT DOCUMENTS

Re. 4,618 * 10/1871 Catlin ..... 474/191
418,469 * 12/1889 McKinley ..... 222/383.1
2,818,201 * 12/1957 Peck ..... 222/382
3,186,598 * 6/1965 Jonsson ..... 222/57
3,193,149 * 7/1965 Beaubien ..... 222/109
5,368,197 * 11/1994 Sutera ..... 222/67
5,553,750 * 9/1996 Foster ..... 222/179.5

* cited by examiner

*Primary Examiner*—Kevin Shaver
*Assistant Examiner*—Stephanie L. Willat

(57) ABSTRACT

A pitcher pump water dispensing system including a pitcher pump that has a generally cylindrical central portion with a centrally pivoted pumping handle that has a drive rod coupled thereto with a one-way seal. The system also includes a reservoir that has a receiving pipe coupled with respect to the bottom region of the pump. The reservoir being adapted to hold water. The system further includes a control assembly that has an intake pipe with a valve and a floating regulator attached adjacent to the intake pipe in operational contact with the valve by means of lever linkage arms. Finally the system includes inlet hose that is coupled to the bottom end of the intake pipe and extending to a water source.

4 Claims, 3 Drawing Sheets

PITCHER PUMP WATER DISPENSING SYSTEM

BACKGROUND OF THE INVENTION

1. Field of the Invention

The present invention relates to a pitcher pump water dispensing system and more particularly pertains to efficiently collecting and storing water from a source until it is ready to be dispensed.

2. Description of the Prior Art

The use of water regulation devices is known in the prior art. More specifically, water regulation devices previously devised and utilized for the purpose of controlling water flow are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,836,346 to Nichols-Roy discloses an pilot operated diaphragm fill valve. U.S. Pat. No. 5,715,859 to Nichols-Roy discloses a adjustable fill valve assembly. U.S. Pat. No. 5,975,125 to Nichols-Roy discloses a combined filter and noise suppressor for fill valve. U.S. Pat. No. 2,434,771 to mueller et al discloses a liquid dispenser. Lastly, U.S. Pat. No. 4,413,778 to Middlemiss discloses an antique lawn pump mobile.

While these devices fulfill their respective, particular objectives and requirements, the aforementioned patents do not describe a pitcher pump water dispensing system that allows for efficiently collecting and storing water from a source until it is ready to be dispensed.

In this respect, the pitcher pump water dispensing system according to the present invention substantially departs from the conventional concepts and designs of the prior art, and in doing so provides an apparatus primarily developed for the purpose of efficiently collecting and storing water from a source until it is ready to be dispensed.

Therefore, it can be appreciated that there exists a continuing need for a new and improved pitcher pump water dispensing system which can be used for efficiently collecting and storing water from a source until it is ready to be dispensed. In this regard, the present invention substantially fulfills this need.

SUMMARY OF THE INVENTION

In view of the foregoing disadvantages inherent in the known types of water regulation devices now present in the prior art, the present invention provides an improved pitcher pump water dispensing system. As such, the general purpose of the present invention, which will be described subsequently in greater detail, is to provide a new and improved pitcher pump water dispensing system and method which has all the advantages of the prior art and none of the disadvantages.

To attain this, the present invention essentially comprises a pitcher pump water dispensing system first includes a pitcher pump that has a generally cylindrical central portion. This central portion has a top region and a bottom region with an opening on the bottom region with female threads. The pump further has a cone shaped open top portion adjacent to the top region of the central portion. The top portion has a laterally disposed dispensing spout. The pump also includes a base with a diameter greater than that the of central portion. The base has a lip with a plurality of bores there through. Next the pump includes a sloping intermediate section between the bottom region of the central portion and the base. The intermediate section has a plurality of openings there through. The pump includes a centrally pivoted pumping handle with a drive rod coupled thereto and a one-way seal. The handle is coupled to a pivot plate. The pivot plate is coupled to the top portion on a side opposite the dispensing spout. When in operation the seal provides a vacuum upon reciprocating of the handle. This draws water up the central portion and out of the spout. The system next includes a reservoir. The reservoir has a cylindrical base section of a uniform diameter with a planar bottom. The reservoir also includes a cylindrical top section with a curved intermediate section. The top section has a curved lip portion. A receiving pipe with an upper end with male threads is coupled to the bottom region of the pump. The receiving pipe has a lower end extending adjacent to the bottom of the reservoir. The reservoir also has handles extending outward from the curved intermediate section. The system further includes a connector. The connector has a solid cylindrical top plate of a diameter slightly greater than that of lip section of the reservoir. The top plate has a central opening and a plurality of bores around the perimeter to receive a plurality of nuts and bolts to couple the connecting means to the base of the pumping means. The connecting means further has a ledge extending down from the top plate. Next, a control assembly has an intake pipe with a top end and bottom end. The bottom end has male threads and the top end has a valve mechanism coupled thereto. The control assembly includes a floating regulator attached adjacent to the intake pipe at a set height to indicate maximum allowed water level in the reservoir. The regulator means responding to the water level in the reservoir and mechanically activates and deactivates the valve by means of lever linkage arms. The control assembly is adjustably held stationary by a upper and lower clamps. The upper clamp is coupled to the lower end of receiving pipe of the reservoir and clasps the bottom end of the intake pipe. The lower clamp is coupled to the top end of the intake pipe and has a long rod parallel to the receiving pipe. The lower clamp also has a guide post associated with it which is coupled to the receiving pipe through which the rod slides. The control assembly allows water to flow into the reservoir when the water level is low as compared to the position of the clamps and stops the flow of water when the desired water level is reached. Furthermore, the system includes an inlet hose. The inlet hose is coupled to the bottom end of the intake pipe of the control assembly. From the intake pipe the inlet hose extends through one of the openings of the intermediate section of the base of the pumping means to a propelled water source. Finally, the system includes a support base. The support base has a round planar platform having a top face and bottom face. A pair of wheels are coupled along a single side and a resting stub is coupled along an opposite side of the bottom face of the support base. The support base allows the system to be easily moved and as well as rest in a balance fashion.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pitcher pump water dispensing system which has all of the advantages of the prior art water regulation devices and none of the disadvantages.

It is another object of the present invention to provide a new and improved pitcher pump water dispensing system which may be easily and efficiently manufactured and marketed.

It is further object of the present invention to provide a new and improved pitcher pump water dispensing system which is of durable and reliable constructions.

An even further object of the present invention is to provide a new and improved pitcher pump water dispensing system which is susceptible of a low cost of manufacture with regard to both materials and labor, and which accordingly is then susceptible of low prices of sale to the consuming public, thereby making such pitcher pump water dispensing system economically available to the buying public. Even still another object of the present invention is to provide a pitcher pump water dispensing system for efficiently collecting and storing water from a source until it is ready to be dispensed. Lastly, it is an object of the present invention to provide a new and improved pitcher pump water dispensing system including a pitcher pump that has a generally cylindrical central portion with a centrally pivoted pumping handle that has a drive rod coupled thereto with a one-way seal. The system also includes a reservoir that has a receiving pipe coupled with respect to the bottom region of the pump. The reservoir being adapted to hold water. The system further includes a control assembly that has an intake pipe with a valve and a floating regulator attached adjacent to the intake pipe in operational contact with the valve by means of lever linkage arms. Finally the system includes an inlet hose that is coupled to the bottom end of the intake pipe and extends to a water source.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
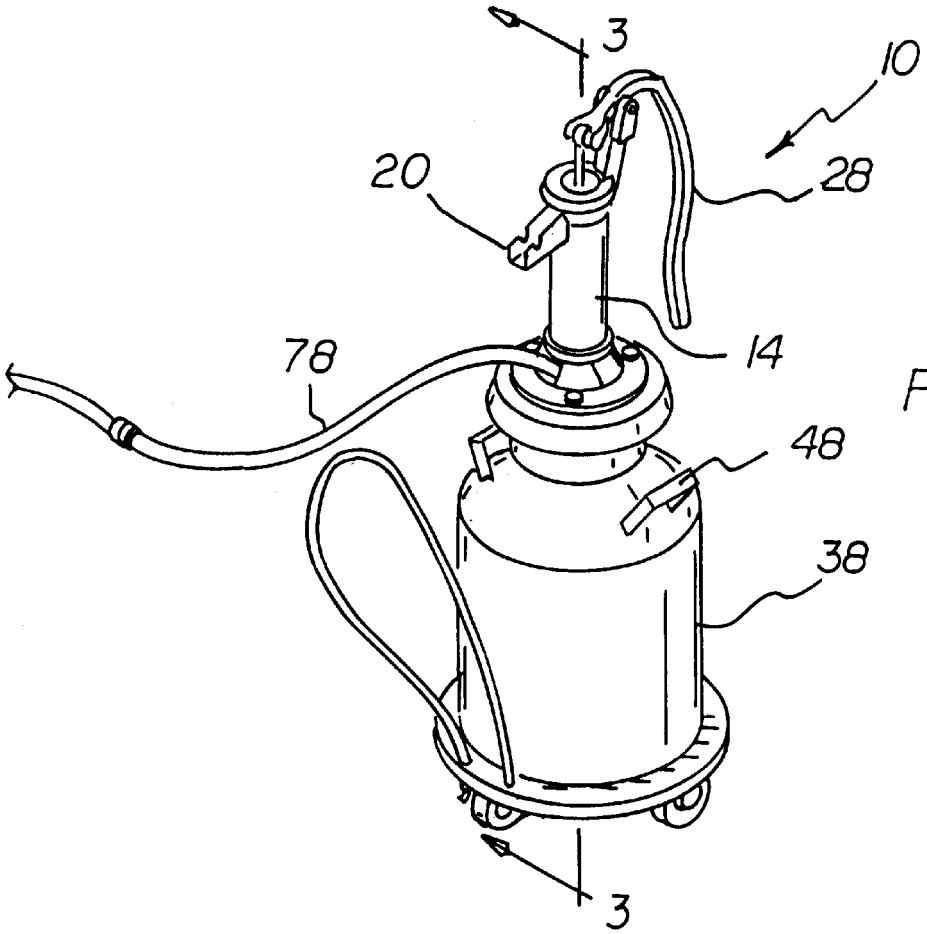
FIG. 1 is a perspective illustration of the preferred embodiment of the present invention.
Figure 2:
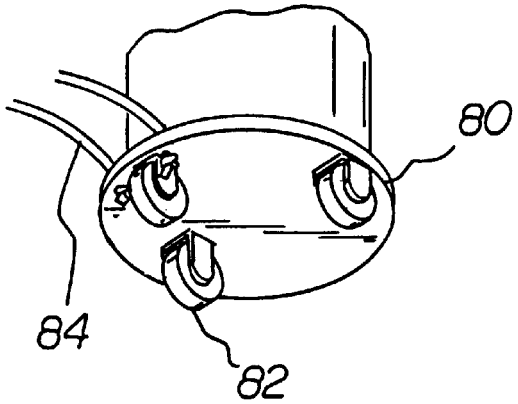
FIG. 2 is a perspective illustration of the under side of the present invention.
Figure 3:
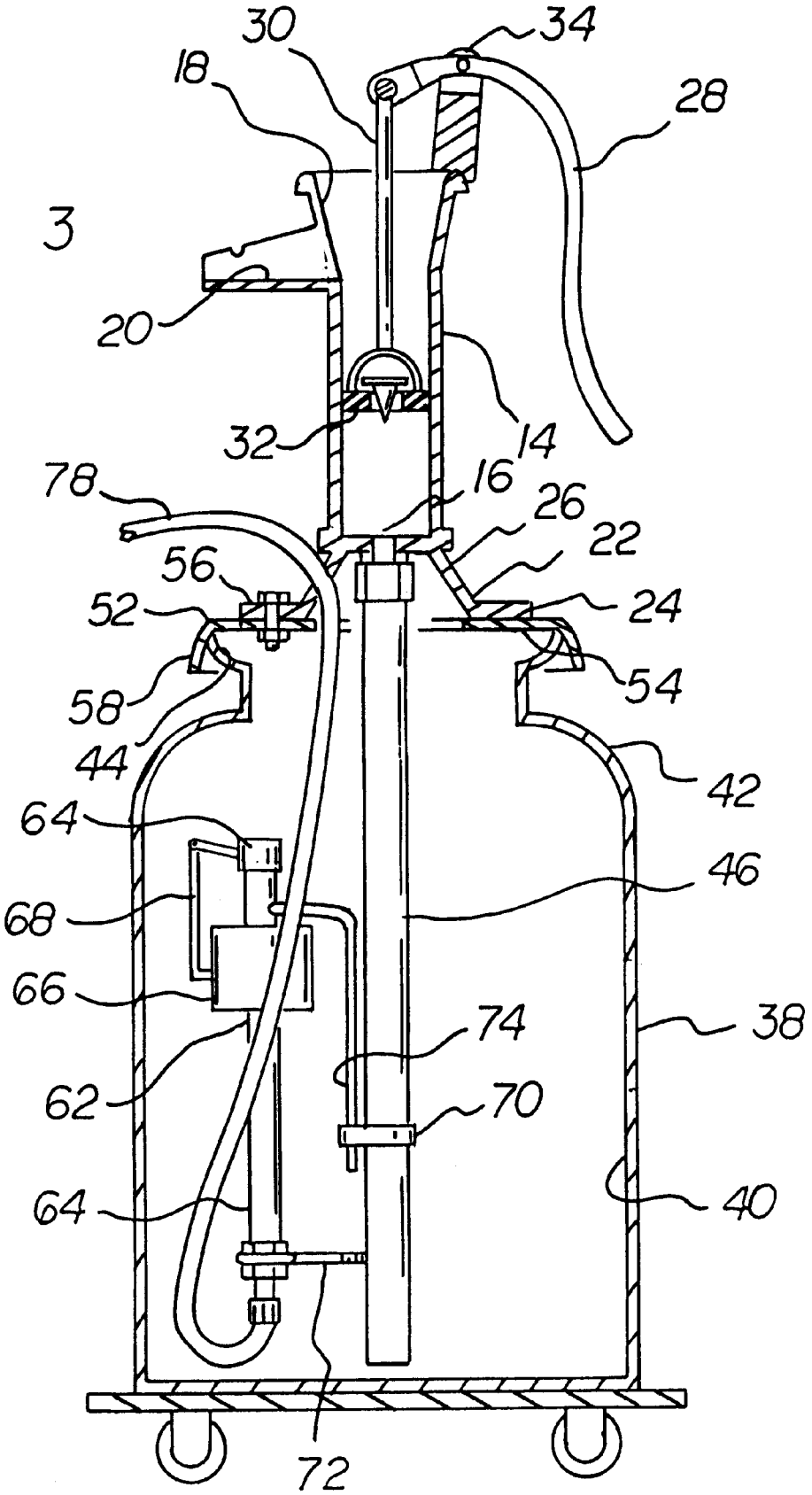
FIG. 3 is a cross sectional view taken along line 3—3 of FIG. 1.

With reference now to the drawings, and in particular to FIG. 1 thereof, the preferred embodiment of the new and improved pitcher pump water dispensing system embodying the principles and concepts of the present invention and generally designated by the reference numeral 10 will be described.

The present invention, the pitcher pump water dispensing system 10 is comprised of a plurality of components. Such components in their broadest context include a pitcher pump, a reservoir, a connector, a control assembly, an inlet hose and a support base. Such components are individually configured and correlated with respect to each other so as to attain the desired objective.

The system first includes a pitcher pump 14 that has a generally cylindrical central portion. This central portion has a top region and a bottom region with an opening 16 on the bottom region with female threads. The pump further has a cone shaped open top portion 18 adjacent to the top region of the central portion. The top portion has a laterally disposed dispensing spout 20. The pump also includes a base 22 with a diameter greater than that the of central portion. The base has a lip 24 with a plurality of bores there through. Next the pump includes a sloping intermediate section 26 between the bottom region of the central portion and the base. The intermediate section has a plurality of openings there through. The pump includes a centrally pivoted pumping handle 28 with a drive rod 30 coupled thereto and a one-way seal 32. The handle is coupled to a pivot plate 34. The pivot plate is coupled to the top portion on a side opposite the dispensing spout. When in operation the seal provides a vacuum upon reciprocating of the handle. This draws water up the central portion and out of the spout.

Figure 4:
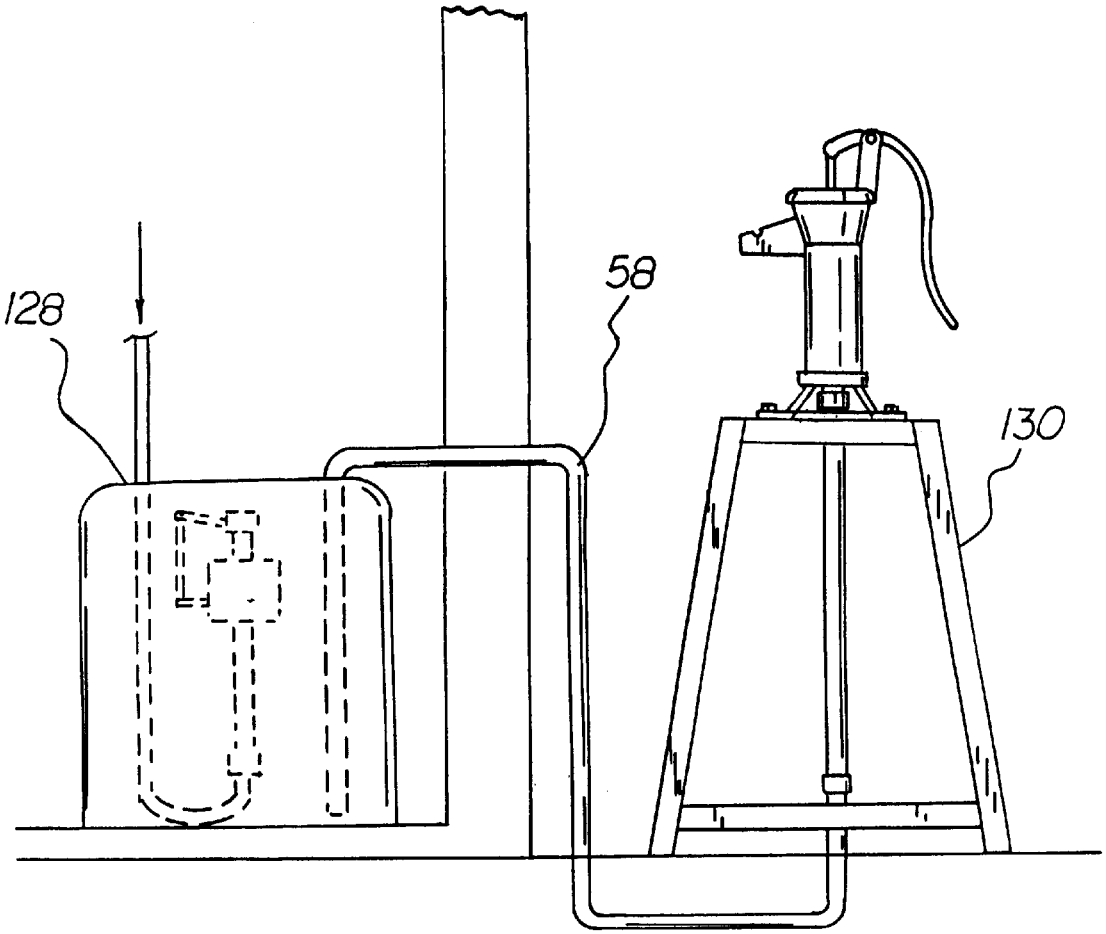
FIG. 4 is an alternative embodiment of the present invention.

The system next includes a reservoir 38. The reservoir has a cylindrical base section 40 of a uniform diameter with a planar bottom. The reservoir also includes a cylindrical top section with a curved intermediate section 42. The top section has a curved lip portion 44. A receiving pipe 46 with an upper end with male threads is coupled to the bottom region of the pump. This receiving pipe is also coupled to a tube when extracting water from a remote reservoir as shown in FIG. 4 which is an alternative embodiment of the present invention. The receiving pipe has a lower end extending adjacent to the bottom of the reservoir. The reservoir also has handles 48 extending outward from the curved intermediate section. Such reservoir is preferably configured to resemble a milk can.

The system further includes a connector 52. The connector has a solid cylindrical top plate 54 of a diameter slightly greater than that of lip section of the reservoir. The top plate has a central opening and a plurality of bores around the perimeter to receive a plurality of nuts and bolts 56 to couple the connecting means to the base of the pumping means. The connecting means further has a ledge 58 extending down from the top plate.

A control assembly 62 has an intake pipe 64 with a top end and bottom end. The bottom end has male threads and the top end has a valve mechanism 65 coupled thereto. The control assembly includes a floating regulator 66. Such regulator is adapted to float on the water. It is attached adjacent to the intake pipe at a set height to indicate maximum allowed water level in the reservoir. The regulator means responds to the water level in the reservoir. It has a central aperture to allow sliding up and down on the intake pipe. It mechanically activates and deactivates the valve by means of lever linkage arms 68 in response to the changing water level. The control assembly is adjustably held stationary by upper and lower clamps 70, 72. The upper clamp 70 is coupled to the lower end of receiving pipe of the reservoir and clasps the bottom end of the intake pipe. The lower clamp 72 is coupled to the top end of the intake pipe and has a long rod 74 parallel to the receiving pipe. The lower clamp also has a guide post associated with it which is coupled to the receiving pipe through which the rod slides. The control assembly allows water to flow into the reservoir when the water level is low and the regulator drops as compared to the position of the clamps and stops the flow of water when the desired water level is reached. Further details may be had by reference to the Nichols-Roy patents discussed herein above, the subject matter of which is incorporated herein by reference.

The system includes an inlet hose 78. The inlet hose is coupled to the bottom end of the intake pipe of the control assembly. From the intake pipe the inlet hose extends through one of the openings of the intermediate section of the base of the pumping means to a propelled water source.

Finally the system includes a support base 80. The support base has a round planar platform having a top face and bottom face. A plurality of wheels 82 are coupled to the bottom face of the support base. The support base allows the system to be easily moved and as well as rest in a balance fashion. A handle 84 may be attached to the support base to facilitate the moving of the system.

An alternate embodiment of the invention is shown in FIG. 4. In such embodiment, the reservoir 128 is laterally offset from the pump with a connecting tube 58 there between. The reservoir is shown inside the building with the pump outside. A control assembly 62, as in the prior embodiment, is within the reservoir. In addition, a pedestal 130 is preferably provided.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pivot pump water dispensing system for efficiently collecting and storing water from a source until it is ready to be dispensed comprising, in combination:

a pitcher pump having a generally cylindrical central portion having top region and bottom region with an opening on the bottom region with female threads, the pump further having a cone shaped open top portion adjacent to the top region of the central portion with the top portion having a laterally disposed dispensing spout, a base with a diameter greater than that the of central portion, the base having a lip with a plurality of bores therethrough, a sloping intermediate section between the bottom region of the central portion and the base, the intermediate section having a plurality of openings therethrough, a centrally pivoted pumping handle with a drive rod coupled thereto, with a one-way seal, the handle being coupled to a pivot plate with the pivot plate being coupled to the top portion on a side opposite the dispensing spout such that the seal provides a vacuum upon reciprocating of the handle for drawing water up the central portion and out of the spout;

a reservoir having a cylindrical base section of a uniform diameter with a planar bottom, a cylindrical top section with a curved intermediate section, the top section having a curved lip portion, a receiving pipe with an upper end with male threads coupled to the bottom region of the pump, the receiving pipe having a lower end extending adjacent to the bottom of the reservoir, handles extending outward from the curved intermediate section;

a connector having a solid cylindrical top plate of a diameter slightly greater than that of lip section of the reservoir with a central opening and a plurality of bores to receive a plurality of nuts and bolts to couple the connecting means to the base of the pumping means, the connecting means further having a ledge extending down from the top plate;

a control assembly having an intake pipe with a top end and bottom end, the bottom end having male threads, the top end with a valve mechanism coupled thereto, a floating regulator attached adjacent to the intake pipe at a set height to indicate maximum allowed water level in the reservoir, the regulator means responding to the water level in the reservoir and mechanically activating and deactivating the valve by means of lever linkage arms, the control assembly being adjustably held stationary by a upper and lower clamps, the upper clamp being coupled to the lower end of receiving pipe of the reservoir and clasping the bottom end of the intake pipe, the lower clamp being coupled to the top end of the intake pipe and having a long rod parallel to the receiving pipe and with a guide post coupled to the receiving pipe through which the rod slides, the control assembly allowing water to flow into the reservoir when the water level is low as compared to the position of the clamps and stops the flow of water when the desired water level is reached;

an inlet hose being coupled to the bottom end of the intake pipe of the control assembly and extending through one of the openings of the intermediate section of the base of the pumping means to a propelled water source; and a support base having a round planar platform having a top face and bottom face with a pair of wheels along a single side and a resting stub along an opposite side of the bottom face of the support base, the support base allowing the system to be easily moved and as well as rest in a balance fashion.

2. A pitcher pump water dispensing system comprising:

a pitcher pump at an elevated orientation having a generally cylindrical central portion with a centrally pivoted pumping handle and with a drive rod coupled thereto with a one-way seal;

a reservoir at an elevation beneath the pitcher pumphaving a receiving pipe coupled with respect to the bottom region of the pump, the reservoir being adapted to hold water;

a control assembly located within the reservoir having an intake pipe with a top end and bottom end, the bottom end having male threads, the top end with a valve mechanism coupled thereto, a floating regulator attached adjacent to the intake pipe at a set height to indicate maximum allowed water level in the reservoir, the regulator responding to the water level in the reservoir and mechanically activating and deactivating the valve by means of lever linkage arms, the control assembly being adjustably held stationary by a first clamp and a second clamp, the first clamp being coupled with respect to the lower end of receiving pipe of the reservoir and clasping the bottom end of the intake pipe, the second clamp being coupled to the top end of the intake pipe and having a long rod parallel to the receiving pipe and with a guide post coupled to the receiving pipe through which the rod slides, the control assembly allowing water to flow into the reservoir when the water level is low as compared to the position of the clamps and stops the flow of water when the desired water level is reached; and an inlet hose having an intermediate portion extending through the reservoir and an outlet portion coupled to the bottom end of the intake pipe and an inlet portion extending to a water source.

3. The pitcher pump water dispensing system as set forth in claim 2 wherein:

the pump is coupled to the top of the reservoir with a connector.

4. The pitcher pump water dispensing system as set forth in claim 2 wherein:

the pump is at a remote location with respect to the reservoir with a water line therebetween.

* * * * *